United States Patent [19]

Feinberg

[11] Patent Number: 5,011,446

[45] Date of Patent: Apr. 30, 1991

[54] TRANSPARENT TOY HOUSE

[76] Inventor: Alec Feinberg, 4 Whiffletree Cir., Andover, Mass. 01810

[21] Appl. No.: 432,361

[22] Filed: Nov. 6, 1989

[51] Int. Cl.[5] ..... A63H 3/52; A63H 33/06

[52] U.S. Cl. ..... 446/85; 446/476; 40/611

[58] Field of Search ..... 446/85, 476, 478, 110, 446/488; 434/72; 40/152, 611, 661

[56] References Cited

U.S. PATENT DOCUMENTS

| | | | |
|---|---|---|---|
| 1,541,556 | 6/1925 | Fisher | 446/85 |
| 3,400,485 | 9/1968 | Callin et al. . | |
| 3,577,672 | 5/1971 | Nutting | 446/85 |
| 3,703,045 | 11/1972 | Nyman | 40/152 |
| 3,719,001 | 3/1973 | Archer . | |
| 4,077,153 | 3/1978 | Dunbar et al. | 446/85 |
| 4,195,437 | 4/1980 | Ace | 446/110 X |
| 4,326,349 | 4/1982 | Daughtry | 40/611 X |
| 4,334,868 | 6/1982 | Levinrad | 434/172 |
| 4,553,344 | 11/1985 | Rubin et al. | 40/152 |
| 4,632,469 | 12/1986 | Lampman | 312/114 |
| 4,723,820 | 2/1988 | Kroneck | 312/223 |

*Primary Examiner*—Mickey Yu

*Attorney, Agent, or Firm*—Wolf, Greenfield & Sacks

[57] ABSTRACT

A transparent house assembly used as a toy consisting of two pieces that include the main structure having the walls of the house and the roof. The walls of the main structure and roof have guides at their edges so that paper may be inserted into the transparent walls. The assembly is designed to be used as a toy house project. A child can draw and color house designs on paper and then insert the designs into the walls and roof for display. The house can also be played with in a manner similar to a doll house.

10 Claims, 3 Drawing Sheets

TRANSPARENT TOY HOUSE

SUBJECT MATTER OF INVENTION

The present invention relates to a transparent house assembly with paper guides designed for use as a toy and includes a method of using the assembly as a toy.

BACKGROUND OF THE INVENTION

Toy houses have always been a source of fascination and interest for children. Toy houses have been designed and made with many different shapes, sizes and colors. Doll houses are a common type of toy houses. Multipurpose toy houses are an added source of interest for both children and parents. These houses are usually designed and either painted and assembled by the manufacturer or come as kits ready to be assembled and painted. Toy house kits offer some freedom for the child to choose paint colors, but the object is to assemble, then paint the house and continually use with one fixed design. These houses are usually made of wood or precolored plastic and no method exists whereby a child can easily change colors or include his or her own figurative drawings of a house.

Similarly, many drawing books exist with interesting figures of houses for a child to color-in, but no method is readily available for a child to conveniently display them through the sides of a toy house's inside surfaces and easily conform to the three dimensionality of a toy house.

The purpose of the present invention is to provide a transparent toy house that could be used for general play similar to a doll house and include a method of conveniently holding drawing paper along the house's inside surfaces, whereby a child has a means to display drawings that could be made in the conventional manner as in a coloring book.

The method of holding paper inside and along plastic surfaces is of course not new. There are a variety of methods for holding pictures and drawings available. Transparent plastic picture frames make use of paper guides. Another method is preformed cardboard made to fit a plastic open face cubical or even cubical or even poly-faced transparent plastic structures used for holding and displaying pictures or drawings. For example, U.S. Pat. No. 4,738,039 issued Aug. 12, 1986 to Sun et al. discloses a detachable polygonal picture frame, U.S. Pat. No. 3,787,992 issued July 24, 1972 to Leonhardt discloses a depth dimensional picture frame. In addition multiframe structure have been disclosed by Rubin et al. in U.S. Pat. No. 4,553,344 and Rosenberg U.S. Pat. No. 4,070,780. Furthermore, Livingston et al. in U.S. Pat. No. 4,738,038 discloses an open ended advertising display card apparatus and container with a receptacle for holding items such as packets of salt and pepper.

However, to the best of the applicant's knowledge, there have been no multipurpose toy house inventions made explicitly for the display of a child's drawings of house type images that could easily be displayed through a toy house's surfaces and also the toy house in the conventional playful manner as in doll house use.

SUMMARY OF INVENTION

The present invention comprises a transparent toy house assembly consisting essentially of the house's main structure that has generally three walls with paper guides and a roof with paper guides. The guides are used to hold a child's drawings. This invention provides a unique project-oriented toy whereby a child can draw and color in house type images in a conventional manner, such as in a coloring book, and then display the drawings by folding them and inserting them along the three dimensional boundaries of the toy house. The house can also be played with in the conventional manner similar to a doll house. The invention offers the child the opportunity to personalize the toy house with many different kinds of house drawings that could easily be exchanged at any time. This would provide the possibility of many imaginative play house scenes such as a colored brick house, straw house, candy colored house, etc. Many different designs are possible.

While the above description in this application has contained a specific example of the toy house's shape and method of holding the paper using paper guides, this description should not be construed as limitations on the scope of the invention, but rather as an exemplification of one preferred embodiment thereof. Many other variations are possible. For example, each wall itself could have two guides to hold the drawings. Also preformed cardboard in the shape of the house could be inserted behind the drawings to support them. The house design could easily include other floors for play, and a chimney on the roof with paper guides. The guides could be used to hold other paper-like material that a child could decorate for personalized display. Accordingly, the scope of the invention should be determined not by the embodiment(s) illustrated, but by the appended claims and their legal equivalents.

DESCRIPTION OF DRAWINGS

The foregoing objects and advantages of the present invention will be more clearly understood when considered in conjunction with the accompanying drawings of which.

REFERENCE NUMBERS IN DRAWINGS

10 transparent roof.
12 paper guides of roof
14 drawing example of roof shown folded and ready to be inserted
16 main structure of transparent toy house
18 paper guides of toy house's main structure
20 drawing example of toy house's main structure shown folded and ready to be inserted

DETAILED DESCRIPTION OF THE INVENTION

Figure 1:
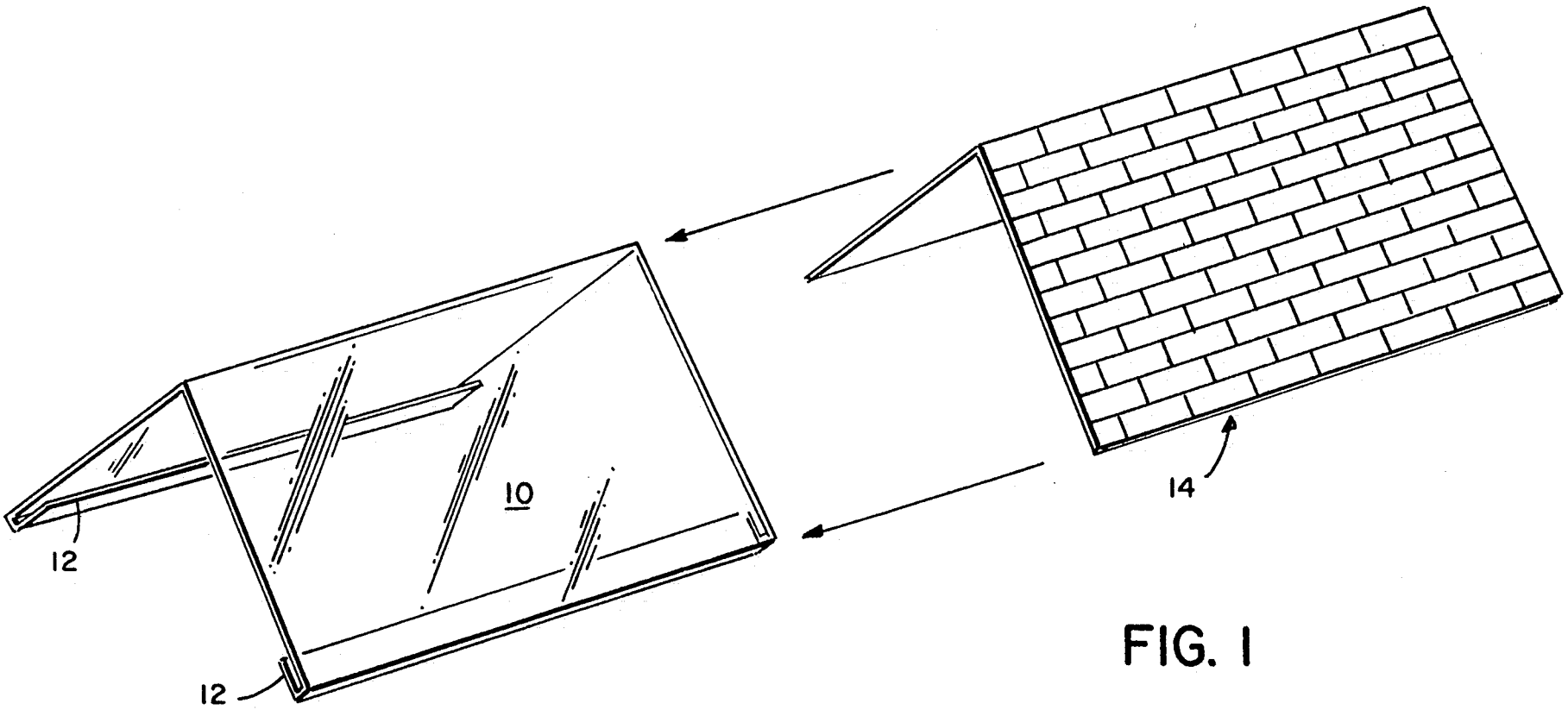
FIG. 1 shows the toy house transparent roof labelled 10 with paper guides labelled 12. Also included in FIG. 1 is an example of a drawing of a roof labelled 14 that could be inserted into the guides.
Figure 2:
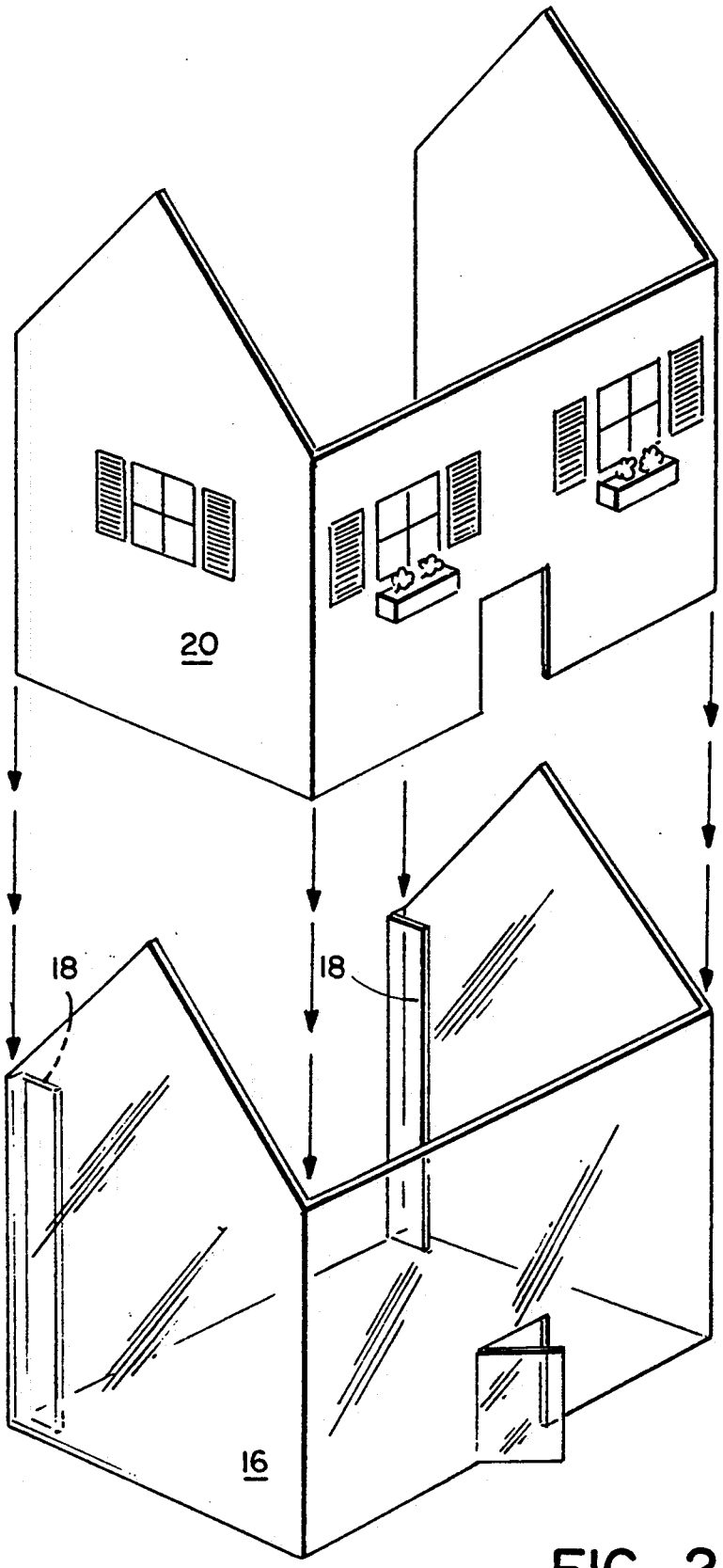
FIG. 2 shows the toy house main structure labelled 16 with paper guides labelled 18. Also included in FIG. 2 is an example of a drawing of the main structure labelled 20 that could be inserted into the guides.
Figure 3:
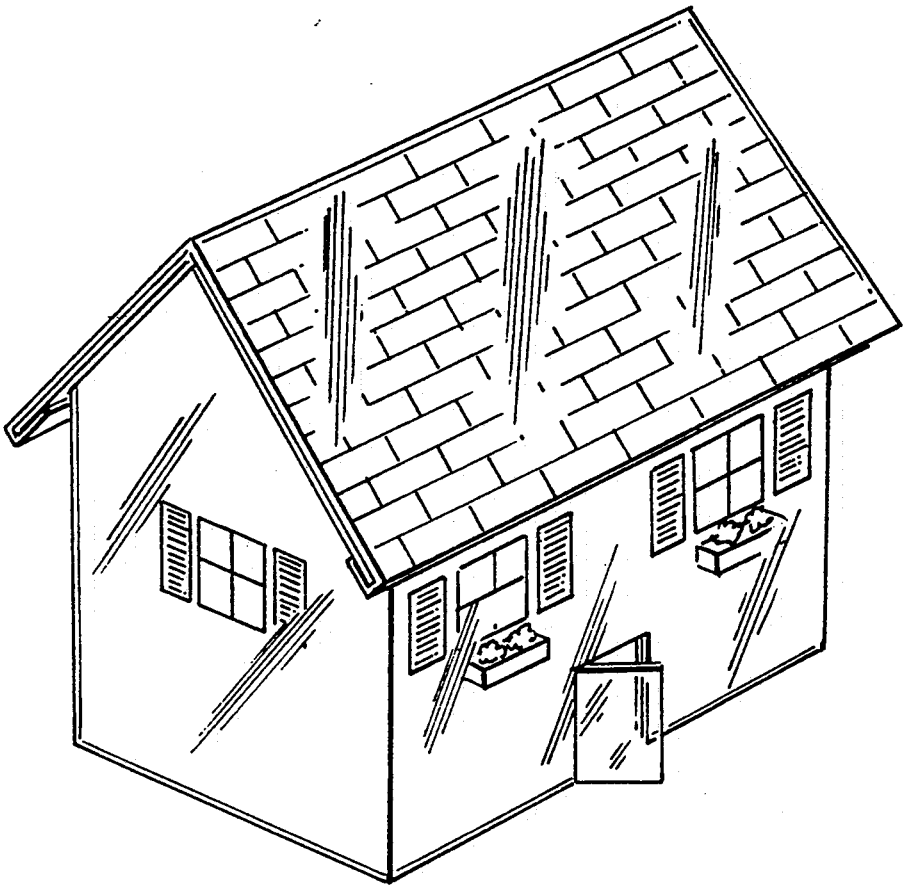
FIG. 3 shows the full view of the assembled transparent house with main structure and roof of house with example drawing paper inserted into each element.

This is a transparent house assembly to be used as a toy and consists of the house's main structure having usually three walls of house and preferably a floor and a transparent roof. In the preferred embodiment the house is approximately 7 inches wide, 5 inches in length, and stands about 7 inches tall. The walls of the main structure and the roof are constructed with guides so that paper may be inserted into the house's walls and roofs and then displayed. This would create a project oriented toy where a child could color in house designed image in a coloring book and then cut out this image and slide the paper image into the walls or roof. The back of the toy house is open so that the house could also be used for play as in doll house use. This idea is illustrated in the figures. In FIG. 1 the transparent roof is shown and is labelled 10 with simple guides labelled 12. The cut out paper with an image of a roof's design is shown also in the figure and is labelled 14. Arrows in the figure indicate the intention of sliding the paper into the roof so that it can be inserted under the roof and held there by the guides. The roof can then be placed on top of the house's main structure and displayed The house's main structure is shown in FIG. 2 and is labelled 16 with simple guides labelled 18 in the figure. An example is shown of a folded cut out drawing having a possible house image that a child could create and/or color-in and is shown in the figure labelled 20. In a similar manner as previously described above the cut-out image of the main house's structure can be slid into the guides labelled 18 and displayed through the transparent walls of the main structure. The roof may then be placed onto the house's main structure. The completed assembly is shown in FIG. 3.

The transparent toy house can be made of conventional clear plastic material such as clear Plexiglass, clear polystyrene, or other suitable materials. The method of inserting the designed paper into the walls of the house can be done in a number of ways other then the suggested construction in the drawings.

Having now described my invention, I claim:

1. A model of a structure having internal and external features comprising, a first plurality of fixedly attached transparent walls and a second plurality of fixedly attached transparent walls, said first and second plurality of walls removably engaged with each other, each of said walls having an inner side and an outer side, said walls shaped and sized to stimulate the walls of said structure, means bearing images of said features, and means for supporting said means bearing images of said features, said supporting means attached to said inner sides of the said walls, said means bearing images of said features adapted to be removably supported on said supporting means with said images visible through said transparent walls.

2. The model of claim 1 wherein the means bearing images comprise sheets of material.

3. The model of claim 1 wherein the supporting means comprise projections integral with the inner periphery of at least one of said transparent walls.

4. The model of claim 2 wherein the means bearing images comprise sheets of material bearing representations that identify external features of the structure.

5. A three-dimensional model of a house comprising, a plurality of connected and angularly related exterior and interior transparent surfaces defining an interior space, said surfaces further defining an open wall for, gaining access to the interior space of the house, and wherein at least one of the interior surfaces of the house has a means attached thereto for removably supporting material bearing images inserted thereinto for display.

6. A toy house structure comprising upstanding transparent wall means and transparent roof detachably connected thereto said wall means and roof having inner and outer surfaces, wherein at least one of the inner surfaces of said wall means and roof have means for accepting material bearing an image inserted thereinto for temporary display.

7. The structure of claim 6, wherein the means for accepting material bearing an image comprises a projection integral with the inner periphery of at least one of said wall means and roof.

8. The structure of claim 6, wherein the wall means and roof are constructed of clear plastic material.

9. The structure of claim 6 further comprising material bearing an image thereon, said material bearing an image covers substantially the entire inner surface of at least one of said wall means and roof.

10. The structure of claim 8, wherein the wall means and roof are constructed of plastic selected from Plexiglass and polystyrene.

* * * * *